US005151015A

United States Patent [19]

Bauer et al.

[11] Patent Number: 5,151,015

[45] Date of Patent: Sep. 29, 1992

[54] COMPRESSION DEVICE, PARTICULARLY FOR THE PRESSURE FILLING OF A CONTAINER

[75] Inventors: Daniel Bauer, Le Raincy; Frédéric Leroy, Saint-Cloud; Gérard Braque, Mitry-le-Neuf; André Charon, Louvres, all of France

[73] Assignee: L'Oreal, Paris, France

[21] Appl. No.: 698,684

[22] Filed: May 13, 1991

[30] Foreign Application Priority Data

May 15, 1990 [FR] France ..... 90 06043

[51] Int. Cl.[5] ..... F04B 9/04

[52] U.S. Cl. ..... 417/415; 417/18; 74/53; 92/140; 92/162 P; 91/422; 91/222

[58] Field of Search ..... 417/415, 18; 74/53; 92/140, 162 P; 91/422, 222

[56] References Cited

U.S. PATENT DOCUMENTS

| | | | |
|---|---|---|---|
| 1,938,218 | 12/1933 | Dempsey, Jr. . | |
| 3,172,295 | 3/1965 | Hrdina | 74/53 |
| 3,465,952 | 9/1969 | Smith . | |
| 4,381,739 | 5/1983 | Fisher | 74/53 |
| 4,595,495 | 6/1986 | Yotam et al. | 417/18 |

FOREIGN PATENT DOCUMENTS

| | | |
|---|---|---|
| 0286792 | 10/1988 | European Pat. Off. . |
| 1014838 | 8/1952 | France . |
| 2253929 | 7/1975 | France . |
| 347594 | 4/1931 | United Kingdom . |

OTHER PUBLICATIONS

CH-A-152975 (Schweiz. Lok. -Masch. Fabrik) May 1932.

*Primary Examiner*—Richard A. Bertsch
*Assistant Examiner*—David W. Scheuermann
*Attorney, Agent, or Firm*—Cushman, Darby & Cushman

[57] ABSTRACT

The device for the compression of a gas comprises a motor (1), a piston (2) adapted to be displaced linearly in a pump body, transmission means (T) between the motor (1) and the piston (2) adapted to convert the rotary motion generated by the motor (1) into a reciprocating translatory motion by the piston (2). Speed varying means comprising a cam (12) are provided to impart a different speed to the piston (2) of the compressor according to the resistance opposing the motor (1) during one complete admission/compression cycle, so that the resisting torque is substantially constant and so that the motor (1) operates at its maximum torque and therefore at maximum efficiency. The section of the cam (12) is determined so as to ensure substantially isothermal compression of the gas.

17 Claims, 3 Drawing Sheets

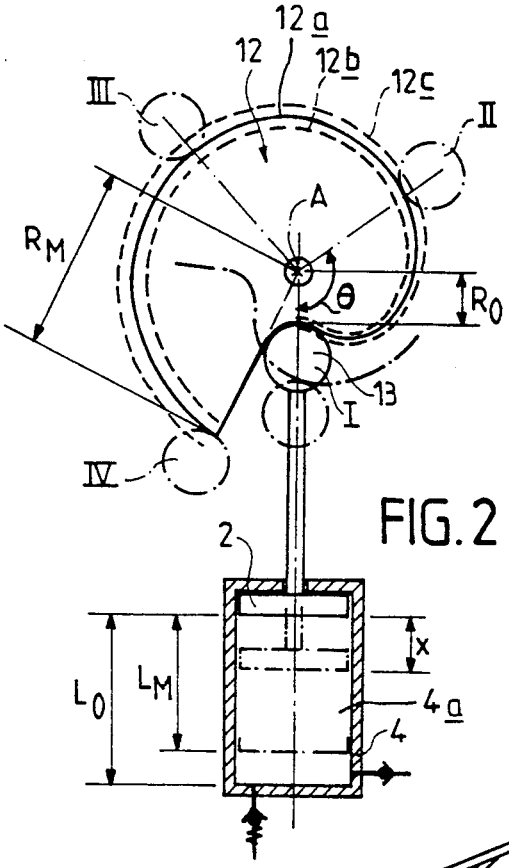
FIG. 2
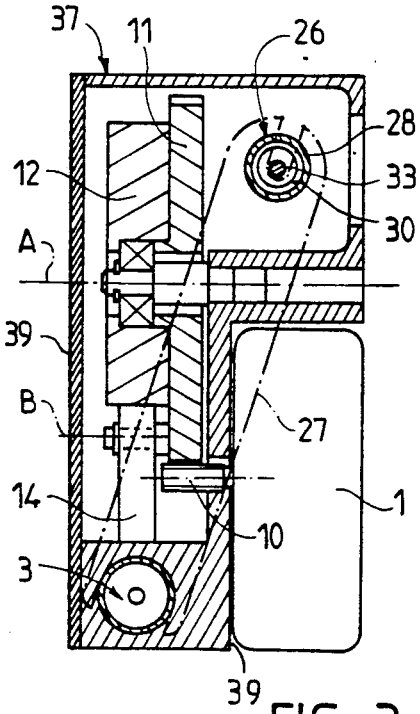
FIG. 3
FIG. 4
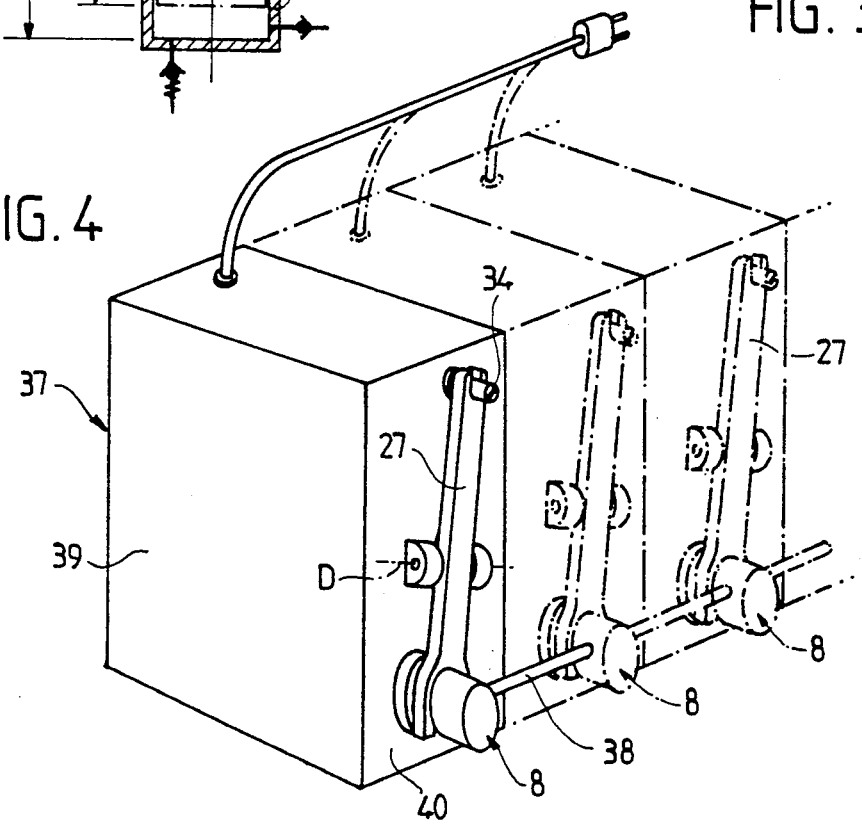

COMPRESSION DEVICE, PARTICULARLY FOR THE PRESSURE FILLING OF A CONTAINER

BACKGROUND OF THE INVENTION

The invention relates to a device for the compression of a fluid, particularly for the pressure filling of a container, of the type comprising a motor, a piston adapted to be displaced linearly in a pump body, transmission means between the motor and the piston adapted to convert the rotary motion generated by the motor into a reciprocating translatory motion by the piston, speed varying means adapted to impart a different speed to the piston of the compressor according to the resistance opposing the motor during one complete admission/-compression cycle, these speed varying means comprising a cam driven in rotation by the shaft of the motor and acting via its periphery on a roller connected to the piston, elastic means being provided to hold the roller against the cam, the whole assembly being such that the resisting torque is substantially constant.

DESCRIPTION OF THE PRIOR ART

EP-A-0 286 792 relates to a device of this type for a liquid-metering pump. According to the embodiment of FIG. 4, the plunger of the pump is displaced by a cam in the shape of a spiral, more precisely in the shape of an Archimedean spiral, the polar radius of which has a length proportional to the polar angle. By this means, it is possible to obtain a substantially constant thrust force on the plunger during the delivery stroke of this plunger. The return stroke of the plunger corresponds to a step of the cam and is effected over a very short period.

By virture of this arrangement, it is possible to improve the overall efficiency and to reduce the required nominal power of the drive motor.

In practice, as liquid is incompressible and as it is delivered at a substantially constant pressure, the desired result can be achieved by virtue of the Archimedean spiral used for the displacement of the plunger. In addition, the compression of the liquid proper creates virtually no problem with respect to heating.

SUMMARY OF THE INVENTION

The invention relates to a device for the compression of a gas, particularly air, the problems posed here being different precisely by virtue of the different nature of the fluids, gases being compressible fluids.

In particular, the compression of a gas is generally accompanied by the generation of heat, this being added to the heat generated by friction, unless very low piston speeds are adopted, this being disadvantageous, inter alia, with respect to the filling time for a container filled with compressed air.

The compression device according to the invention is intended more particularly for the refilling of a container of compressed air adapted, inter alia, to supply pressure cylinders, e.g. associated with small robots, or for refilling aerosol cans with compressed air. The container is filled with compressed air in a general manner until a certain maximum admissible pressure. When this pressure is reached, the compression device is removed from the container. Once the stored quantity of compressed air has been used, the container has to be refilled.

The object of the invention is above all to provide a device for the compression of a gas, by means of which it is possible to improve the operating efficiency without having to use a more powerful motor.

Another object of the invention is to propose a compact, modular compression device, by means of which it is possible to obtain a greater flow rate by means of the association of several compression modules.

In this embodiment, it is more economical, as well as offering more flexibility of application, to associate n compression modules each of which comprises a small power motor than to produce one single module with a motor having a power n times that of the motor of one module. This prevents the multiplicity of different modules according to the power requirement.

The device offers operational reliability in so far as it is admissible for one element, e.g. out of three or five, to be defective for a certain period of time.

According to the invention, a compression device, particularly for the pressure filling of a container, of the type defined hereinbefore is characterised in that:

the compressed fluid is a gas;

the cam has a section determined in such a manner that the displacement of the piston, controlled by this cam, allows for compression of the gas at constant power, according to a variation in pressure in the compression cylinder substantially satisfying the relation PV=constant, for the isothermal compression of a perfect gas, P being the pressure of the gas and V the volume of this gas, and the rotational speed of the cam and thus the piston speed are selected so as to limit the heating of the gas resulting from the difference between the theoretical properties of the perfect gas and the properties of the real gas, and from fricton, thereby ensuring substantially isothermal compression.

The piston speed is less than 10 Hz and preferably less than 3 Hz.

According to the invention, by virtue of the cam, it is possible to achieve substantially isothermal compression of the gas at constant power, corresponding to optimum energy efficiency.

The rotational speed of the cam is generally constant. Under these conditions, the contour of the cam is included between two limit curves, the polar radii of which for an angle $\theta$ are respectively 0.9 R and 1.1 R, the value R being determined by the following equation for the ideal theoretical curve:

$$R = R_o + (R_M - R_o)\frac{P_M}{P_M - P_o}\left[1 - \left(\frac{P_o}{P_M}\right)^{\theta/\theta}{}_M\right]$$

In this equation, R is the polar radius of a running point, $R_M$ is the maximum polar radius of the curve and $R_O$ the minimum polar radius of the curve, $P_O$ is the starting pressure of the gas, generally atmospheric pressure, and $P_M$ is the maximum pressure of the gas. $\theta_M$ varies from 60° to 360°, preferably from 60° to 340°.

The transmission means preferably comprise a pinion fixed to the shaft of the motor which meshes with a toothed wheel to form a reducer, the cam being fixed to an axis passing through the centre of the toothed wheel, the roller being in contact with the periphery of the cam and fixed to the end of a balancer pivoting about an intermediate axis, the other end of the balancer being connected by a rod to the piston.

The piston advantageously comprises an orifice in the extension of the rod and the rod/piston connection is ensured by a loss of motion device, so that in the drive phase of the piston by the rod the orifice is open, allowing for aspiration, while in the thrust phase the orifice is closed by the rod, allowing for compression.

The orifice of the piston is coaxial with the piston and the loss of motion device comprises a unit, connected to the piston, in which there is provided an axial housing having a larger diameter over its length, while the rod comprises a larger diameter over part of its length, the part having the larger diameter being situated in the housing, the length of the part of the rod having the larger diameter being less than the length of the housing of the unit.

The pump body is preferably a syringe body consisting of a cylindrical wall connected by a truncated wall to a nose, the said syringe body being contained within a casing provided at its end close to the nose of the syringe with an end fitting connected by a pipe to the container.

The syringe body advantageously comprises an outlet valve, the said outlet valve consisting of a flexible sleeve arranged around the nose of the syringe comprising at least one opening covered by this sleeve, so that the opening is open during the compression phase and closed during the admission phase.

In a first embodiment, the end fitting is movable and slidably mounted in an end bore of the casing.

The device comprises a pressure switch consisting of a miniature switch and means for adjusting the cut-off pressure controlled by a lever, the said adjusting means comprising an adjusting rod between the miniature switch and the lever, the lever being connected at one of its end to the end fitting and at its other end to the adjusting means, and being mounted to pivot about an intermediate axis, so that when the pressure in the container exceeds the calibration pressure, the end fitting is displaced, resulting in rotation of the lever, displacement of the adjusting rod and cut-off of the motor by the miniature switch.

In a second embodiment, the compression device does not have a pressure switch and the end fitting is fixed. There is a clearance volume in the syringe body which limits the pressure in the container.

In a third embodiment, the elastic means provided to hold the roller against the cam consist of a return spring, particularly a draw spring, connected at one of its ends to the frame and at its other end to a point of the balancer, in the case of a draw spring, particularly to a point of the balancer situated between the hinged pin of the balancer and the roller, the arrangement of the connection points of the ends of the spring being such that the increase in the force of the spring when the roller moves away from the centre of the cam is substantially compensated for by a reduction in the lever arm of the spring, as far as the resisting torque is concerned.

The loss of motion device preferably comprises a ball fixed to the end of the rod, connected to the piston, in which there is provided a housing having a volume greater than that of the ball, the ball being situated in the housing, an annular lip surrounding the orifice in the interior of the housing.

The device comprises a pressure switch consisting of a miniature switch and means for adjusting the cut-off pressure, the said adjusting means comprising a tube, particularly a transparent, graduated tube, connected to the pipe running from the end fitting to the container and in which a piston held back by a draw spring is displaced under the influence of the pressure of the fluid, so that when the pressure in the container exceeds a predetermined maximum admissible pressure, the piston cuts off the motor via the miniature switch. The end fitting is fixed.

The said tube advantageously comprises an orifice situated towards the end at which the piston is located at the end of its stroke, the whole assembly being such that the piston uncovers this orifice, thereby establishing leakage to the atmosphere when the predetermined maximum admissible pressure is reached in the container. This device can act as a safety valve to limit any increase in pressure.

The tube is preferably open at its end close to the miniature switch so that the piston emerges from the tube when the predetermined maximum admissible pressure is exceeded in the container.

Irrespective of the embodiment used, the longitudinal axis of the spring of the adjusting means extends substantially parallel to the axis of the syringe body, the different elements being supported by a frame, the motor being disposed between the longitudinal axis of the spring of the adjusting means and the syringe body, with its axis substantially orthogonal to the plane of the longitudinal axis of the spring of the adjusting means and the axis of the syringe body.

The invention also relates to a compression assembly, characterised in that it comprises compression devices disposed in parallelepipedal chambers and arranged in parallel, large face against large face, the outlet end fitting, the lever and the end of the adjusting screw projecting out from one narrow face of the chamber.

In the case of the device in which the means for adjusting the cut-off pressure comprise a graduated transparent tube, the graduation of the tube is advantageously visible on one narrow face of the chamber.

BRIEF DESCRIPTION OF THE DRAWINGS

The subject matter of the invention will be more readily understood from the following description of one embodiment, given purely by way of a non-limiting example and with reference to the accompanying drawings, in which:

FIG. 2 shows a front view of the cam, and the roller in various positions of its movement, a cylinder and its piston being shown in diagrammatic form;

FIG. 3 is a section through the device along a plane passing through the axis of rotation of the toothed wheel and the axis of the pinion of the motor;

FIG. 4 is a perspective view of a compression system consisting of several compression modules arranged in parallel;

DETAILED DESCRIPTION OF THE INVENTION

Figure 1:
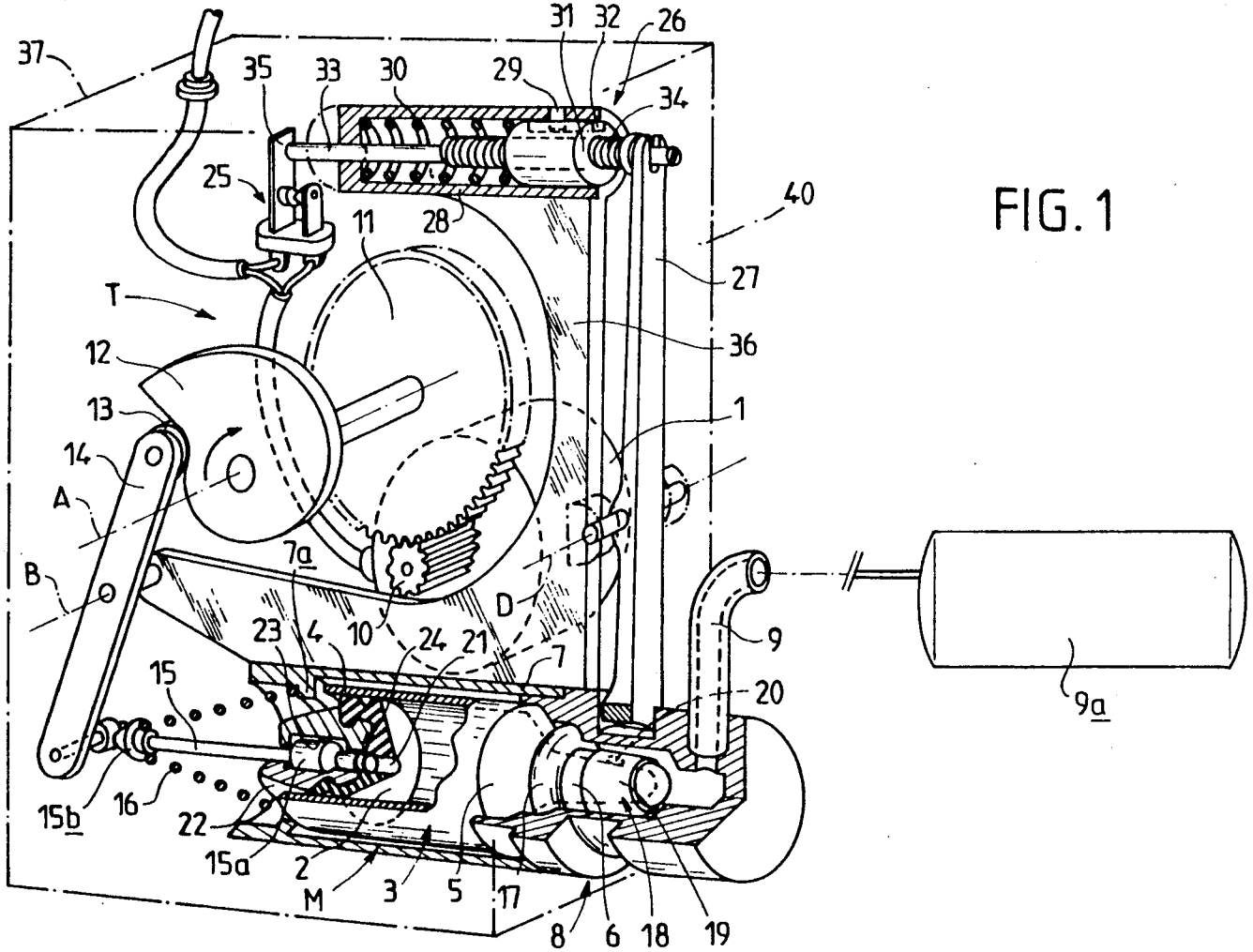
FIG. 1 is a diagrammatic perspective of the compression device according to the invention.

Referring to FIG. 1, it will be seen that the compression device comprises a motor 1, compression means M and transmission means T.

The compression means M consist of a piston 2 displaced in a linear reciprocating manner in a syringe body 3. The syringe body 3 comprises a cylindrical wall 4 connected by a truncated wall 5 to a nose 6. The said syringe body 3 is contained within a casing 7 forming part of a frame 36, provided with an outlet end fitting 8 at its end close to the nose 6 of the syringe 3, the end fitting 8 being connected by a pipe 9 to a container 9*a*. The outlet end fitting 8 is rotatably mounted in the casing 7.

The transmission means T comprise a toothed pinion 10 fixed to the shaft of the motor 1 which meshes with a toothed wheel 11 to form a reducer, a cam 12 fixed to an axis A passing through the centre of the toothed wheel 11, and a roller 13 in contact with the periphery of the cam 12 and fixed to one end of a balancer 14, the balancer pivoting about an axis B. The other end of the balancer is connected to a rod 15 which controls the displacement of the piston 2. The cam 12 constitutes speed varying means and its section is substantially in the shape of a spiral, this being illustrated in FIG. 2. The roller 33 is held against the cam 12 by elastic means, consisting of a return spring 16 working in compression and resting at one end against a shoulder 7*a* of the casing 7 and at its other end against a shoulder 15*b* of the rod 15.

The compression device is adapted for the compression of a gas, more particularly air.

The cam 12 has a section 12*a* (FIG. 2) determined in such a manner that the displacement of the piston 2, controlled by the said cam 12, can substantially satisfy the relation PV=constant, for the isothermal compression of a perfect gas at constant power. P is the pressure of the gas in the chamber 4*a* of the cylindrical wall 4 of the syringe body, defined by the piston 2. V is the volume of this chamber 4*a* in which the gas being compressed is confined.

The rotational speed of the cam 12 is selected so that the piston speed limits the heating of the gas resulting from the difference between the theoretical properties of the perfect gas and the properties of the real gas.

The rotational speed of the cam is generally constant. FIG. 2 shows a cam 12 according to the invention, adapted to rotate at a constant speed about its axis A and acting on a roller 13 supported directly at one end of the rod 15 of the piston 2. The axis of the cylinder 4 passes through the centre of the cam 12. The geometric configuration of FIG. 2 is substantially equivalent to that of FIG. 1, in so far as the axis B of the lever 14 in FIG. 1 is equidistant from the hinges provided at either end of this lever.

The section 12*a* of the cam 12 is defined in polar coordinates with centre A, and axis of origin of the polar angles $\theta$ coinciding with the axis of the cylinder 4 passing through A, as follows:

Firstly, it is stated that the operation is effected at constant power $\rho$, i.e.:

$$\rho = c\frac{d\theta}{dt} = \text{constant}$$

C=constant torque t=time.

If S is the section of the piston 2, x is the x-axis at the time t of the piston and P(x) is the pressure of the compressed gas in the cylinder 4 at the position x of the piston, then it can also be stated that $$\rho = SP(x)\frac{dx}{dt} = c\frac{d\theta}{dt} \quad (1)$$

It can also be stated that the product:

$$P(x)V(x) = constant$$

V(x) is the volume of the compressed gas when the piston 2 is in the position x.

This corresponds to isothermal compression of a perfect gas.

The initial pressure for x=0 is designated by $P_o$. It is equal to atmospheric pressure. The corresponding volume of the compression chamber is designated by $V_o$.

If $L_o$ is the maximum length of the compression cylinder 4, then:

$$V_o = SL_o.$$

The maximum pressure is designated by $P_M$, corresponding to the working stroke $L_M$ ($L_M$ less than $L_o$) of the piston.

The relation: PV=constant gives:

$$P_oV_o = P_xV_x = P_MV_M.$$

As $$V_x = S(L_o - x).$$

it can be deduced that:

$$P_x = P_o\frac{L_o}{L_o - x}$$

If $R_o$ is the minimum radius vector of the cam 12 for $\theta=0$, and $R_M$ is its maximum radius vector for $\theta_M$, this gives the relations:

$$R = x + R_o\ x = R - R_o$$

(R=radius vector at a running point) and maximum radius $$R_M = L_M + R_o \rightarrow L_M = R_M - R_o$$

Taking the equation (1) and using the above relations, this gives $$c\frac{d\theta}{dt} = SP(x)\frac{dx}{dt} = SP_o\frac{L_o}{L_o - x}\ \frac{dx}{dt}$$

Solving this differential equation, taking account of the boundary conditions, gives the following polar equation:

$$R = R_o + (R_M - R_o)\frac{P_M}{P_M - P_o}\left[1 - \left(\frac{P_o}{P_M}\right)^{\theta/\theta}{}_M\right]$$

In practice, the section 12*a* of the spiral 12 is close to that determined by this equation and included between the two limits 12*b*, 12*c* indicated by dash-dotted lines in FIG. 2, corresponding to curves the radius vectors of which are equal respectively to 0.9 R and 1.1 R.

The syringe body 3 comprises an O-ring seal 17 at the base of the nose 6. The syringe body 3 comprises an outlet valve 18 consisting of a flexible sleeve 19 arranged around the nose 6 of the syringe which is provided with an opening 20 covered by the sleeve 19.

The piston 2 has an orifice 21 in the extension of the rod 15, coaxial with the piston 2. The rod/piston connection is ensured by a loss of motion device. The loss of motion device comprises a unit 22, connected to the piston 2, in which there is provided an axial housing 23 having a larger diameter over its length, while the rod 15 comprises a larger diameter over part 15*a* of the length. The part 15*a* of the rod 15 having the larger diameter is situated in the housing 23, the length of the part 15*a* of the rod 15 having the larger diameter being less than the length of the housing 23 of the unit 22. The loss of motion system forms an inlet valve 24 for the syringe body 3.

In the embodiment illustrated in FIG. 1, the compression device also comprises a pressure switch consisting of a miniature switch 25 and means 26 for adjusting the cut-off pressure controlled by a lever 27. The adjusting means 26 comprise a cylinder 28 integral with the frame 36. The cylinder has its axis parallel to that of the casing 7 and is situated towards the edge of the frame opposite this casing. The frame 36 forms a sort of C, the median plane of which is parallel to the axes of the cylinder 28 and the casing 7, and orthogonal to the axis of the motor 1. The wheel 11 is disposed in the concavity of the C-shaped frame and the axis B is supported at one end of the open loop of the C.

A screw 29 traverses radially the wall of the cylinder 28 to project into the interior. The adjusting means 26 also comprise a regulating spring 30, a nut 31 having an outer cylindrical surface provided with a groove 32 and an adjusting rod 33 threaded over part of its length forming an adjusting screw 34. The regulating spring 30 is arranged in the cylinder 28 and rests on the base of the cylinder 28 and on the nut 31. The adjusting rod 33 traverses the interior of the cylinder, the threaded part 34 of the rod 33 being engaged with the threading of the nut 31. The screw 29 is housed in the groove 32 of the nut 31 so as to prevent rotation of the nut 31 in the cylinder 28. By virtue of the adjusting screw 34, it is possible to control the displacement of the nut 31 in the cylinder 28 and to modify the compression of the regulating spring 30 by rotation of the adjusting rod 33. The stiffness of the regulating spring 30 can therefore be adjusted by the adjusting screw 34. The adjusting rod 33 rests against a plate 35 of the miniature switch 25 at the end of the rod 33 opposite to the one at which the adjusting screw 34 is located. At its other end, the rod 33 rests against one end of the lever 27. The rod 33 can slide and rotate in the cylinder 28. The lever 27 is connected to the end fitting 8 at its end remote from the rod 33 and is mounted to pivot about an intermediate axis D.

According to the invention, the compression device is arranged in a parallelepipedal chamber 37, the outlet end fitting 8, the lever 27 and the end of the adjusting screw 34 projecting out from one narrow face 40 of the chamber 37.

The operation of the compression device just described will now be described in more detail.

Before the compression phase, the centre of the roller 13 is at a minimum distance from the axis A, corresponding to position I in FIG. 2. When the cam 12 is driven in rotation by the toothed wheel 11, in the clockwise direction according to the representation of the drawings, the roller 13 follows the section of the cam 12, as shown by positions II and III in FIG. 2. The centre of the roller 13 then moves gradually away from the axis A, so that the balancer 14 pivots about the axis B. The rotation of the balancer 14 results in longitudinal displacement of the rod 15 and compression of the return spring 16. The rod 15 pushes the piston 2 into the syringe body 3 and closes the orifice 21 of the piston 2. At the end of the compression phase, the roller is located in position IV of FIG. 2. The piston 2 rests against the truncated wall 5 of the syringe body 3, so that the clearance volume of the syringe body is minimal. The compressed air escapes via the outlet valve 18 then supplies the container 9*a* via the pipe 9.

As the compression is substantially isothermal, heating is minimal and efficiency is improved. By virtue of the operation at constant power, it is possible to optimise the capacity of the electric drive motor.

The admission phase is ensured by the resilience of the return spring 16. During the backspringing of the return spring 16 the centre of the roller 13 moves from its position furthermost from the axis A to its position closest to the axis A, corresponding to movement from position IV to position I in FIG. 2. During the admission phase, the piston 2 is displaced in the syringe body 3 at a higher speed than in the case of the compression phase. The rod 15 draws the piston 2 and the orifice 21 of the piston 2 is then open, allowing for the aspiration of air into the syringe body 3.

As long as the pressure in the container 9*a* does not reach the maximum admissible filling pressure, the adjusting means 26 hold the end fitting 8 against the casing 7 by means of the lever 27. When the pressure of the container 9*a* reaches the maximum admissible filling pressure, the end fitting 8 is displaced longitudinally towards the exterior by approximately 1 mm, resulting in rotation of the lever 27 about the axis D. The adjusting rod 33 is then displaced longitudinally in the direction opposite the direction of displacement of the end fitting 8, resulting in displacement of the plate 35 of the miniature switch 25. The motor 1 is then cut off by the miniature switch 25.

When the pressure in the container begins to fall, there is a drop in pressure in the interior of the end fitting, so that the regulating spring 30 returns the end fitting to its position against the casing 7 by means of the lever 27. The adjusting rod 33 undergoes displacement so that the miniature switch 25 starts the motor 1.

In another simpler embodiment, the compression device does not have a pressure switch, the end fitting 8 is fixed and the piston 2 does not rest against the truncated wall 5 of the syringe body 3, so that there is a clearance volume in the syringe body 3.

As soon as the pressure in the container 9*a* is equal to the pressure in the clearance volume of the syringe body 3 at the end of the compression phase, the outlet valve 18 is closed, without the motor 1 stopping.

In the embodiment illustrated in FIG. 3, the compression device is disposed in such a manner that it has a compact appearance. As can be seen in FIG. 3, the motor 1 is disposed against a large face 39 of the chamber 37 and the adjusting means 26 are situated above the motor 1, with their axis orthogonal to that of the motor 1. The transmission means T, comprising the pinion 10, the wheel 11 and the cam 12, are disposed in the vicinity of the upper part of the other large face 39 of the chamber 37. The syringe body 3 is disposed in the lower part of this large face 39, with its axial parallel to that of the adjusting means 26. The lever 27 is inclined relative to the vertical.

Referring to FIG. 4, it will be seen that the compression system consists of several compression modules arranged in parallel, the large faces 39 resting one against the other, in or order to speed up filling of the container 9*a*. The outlets of the end fittings 8 of the modules are connected by a flexible tube 38. All of the modules can be provided with a device for stopping the motor, although this is not necessary. One single module provided with a device for stopping the motor may be sufficient, this device stopping the other modules simultaneously, either directly or by means of a relay, when the breaking power of the miniature switch 25 is in danger of being exceeded.

Figure 6:
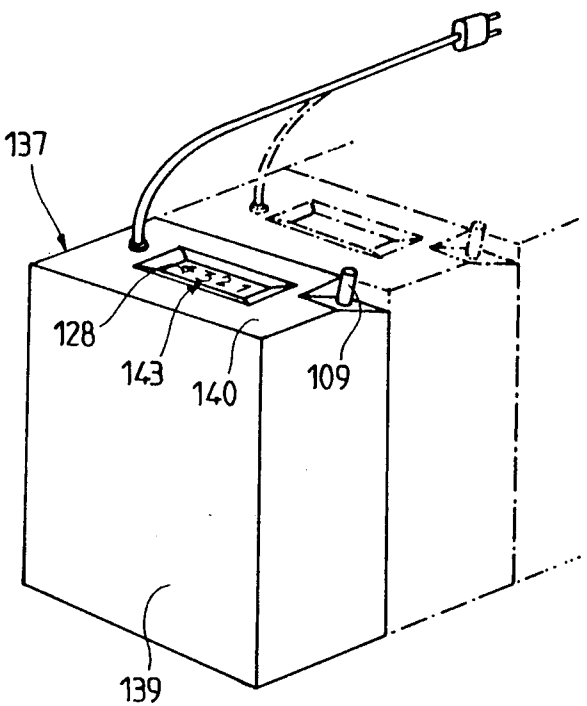
FIG. 6 is another perspective view of another compression system.
Figure 5:
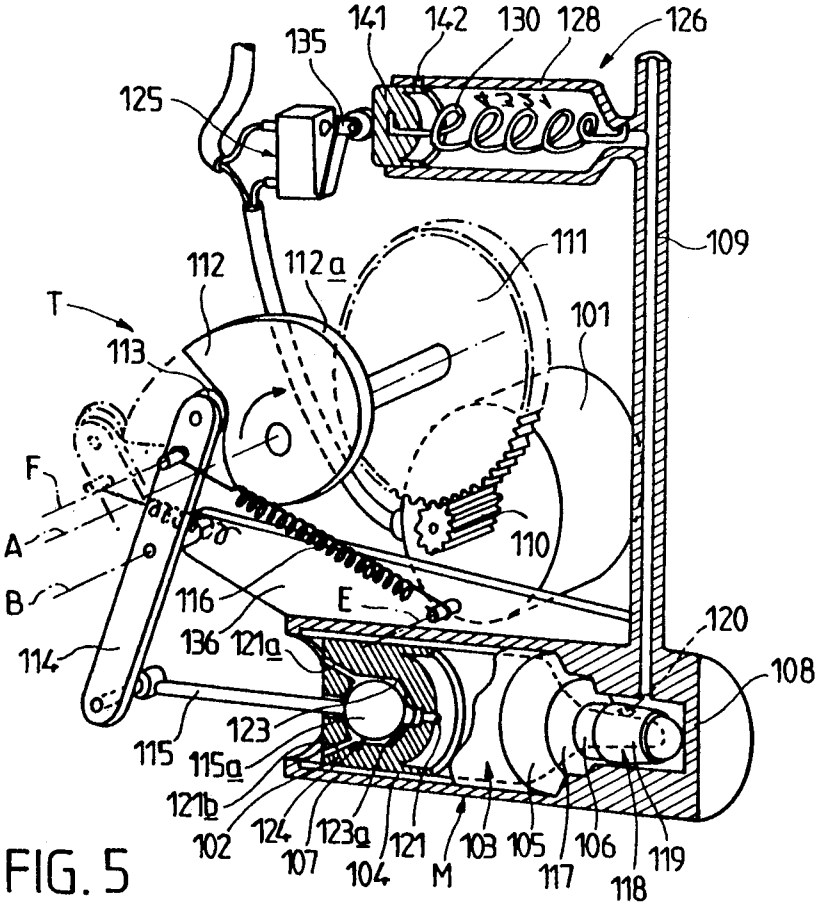
FIG. 5 is a diagrammatic perspective of another embodiment of the compression device according to the invention, and, finally.

FIGS. 5 and 6 show a compression device corresponding to a third embodiment of the invention. The elements of this device which are identical to or play analogous roles to the elements described with reference to the preceding figures are designated by reference numerals equal to the reference numerals used previously plus 100. The description of these elements will not be repeated or will only be given in brief.

Referring to FIG. 5, it will be seen that the elastic means provided to hold the roller 113 against the cam 112 consist of a return spring 116. In this particular example, the return spring 116 consists of a draw spring connected at one of its ends to an axis E integral with the frame 136 and at its other end to an axis F of the balancer 114, the axis F being situated between the axis of rotation B of the balancer 114 and the roller 113. The arrangement of the spring 116 and the connection points E, F of the ends of the spring is such that when the distance EF increases (and therefore when the force of the spring 116 increases), the distance from the axis of rotation B to the line EF decreases. As a result, the lever arm of the force developed by the spring 116 relative to the axis B decreases, this compensating for the increase in the force with respect to the restoring torque. When the elongation of the spring 116 is minimal, the line EF is preferably tangential to the circumference centred on B and passing through F.

The inlet valve 124 of the syringe body 103 consists of a loss of motion device disposed in the piston 102. The loss of motion device comprise a ball 115*a* fixed to the end of the rod 115, connected to the piston 102, in which there is provided a housing 123 having a volume greater than that of the ball 115*a*. The ball 115*a* is situated in the housing 123. The piston 102 has an orifice 121 in the extension of the rod 115 and two inlet orifices 121*a* and 121*b*. An annular lip 123*a* surrounds the orifice 121 in the interior of the housing 123.

The outlet end fitting 108 is integral with the casing 107 containing the syringe body 103 and comprises a pipe 109 connected to a container (not shown).

A pressure switch is arranged on the pipe 109. The pressure switch consists of a miniature switch 125 and means 126 for adjusting the cut-off pressure. The adjusting means 126 comprise a transparent graduated tube 128 open at the end not connected to the pipe 109. A piston 141 connected to a draw spring 130 is displaced in the tube 128. The face of the piston 141 is directed towards the exterior. The control lever 135 of the miniature switch 125 is opposite the open end of the tube 128. The tube 128 comprises a venting orifice 142 towards its open end.

The operation of the compression device just described will now be described in more detail.

Before the compression phase, the return spring 116 is at its minimum elongation and the lever arm of the spring is at a maximum. At the end of the compression phase, i.e. when the roller 113 is situated in position IV in FIG. 2, the return spring 116 is at its maximum elongation and the lever arm of the spring is at a minimum (position indicated by the dotted line in FIG. 5). It will be seen in this manner that the arrangement of the return spring 116 is such that the increase in the force of the spring 116 by extension is substantially compensated for, with respect to the restoring torque, by a reduction in the lever arm of the spring, so that the energy absorbed by the spring 116 and required at the motor 101 is substantially constant during the compression phase. This stored energy is then released for the admission phase.

During the compression phase, the ball 115*a* presses against the inner annular lip 123*a* and closes the orifice 121, the annular lip 123*a* sealing the orifice 121 to a greater extent the higher the pressure in the syringe body 103. By virtue of the ball 115*a*, it is possible to keep the orifice 121 sealed in spite of the variable inclination of the control rod 115. At the end of the compression phase, the piston 102 rests against the truncated wall 105 of the syringe body 103, so that the clearance volume of the syringe body is minimal.

When the pressure in the container increases, the pressure in the tube 128 also increases and displaces the piston 141 by thrust towards the open end of the tube, the draw spring 130 controlling the displacement of the piston as a function of the pressure in the tube 128. When the pressure in the container reaches a predetermined maximum admissible pressure, the piston 141 pushes the lever 135 of the miniature switch 125 and stops the motor 101.

If the pressure of the container exceeds (accidentally) the predetermined maximum admissible pressure, the piston 141 uncovers the orifice 142 of the tube 128, thereby establishing leakage to the atmosphere and causing a pressure drop in the container.

If the orifice 142 is sealed, the piston 141 continues its displacement and emerges from the tube 128, resulting in rapid emptying of the compressed air.

Referring to FIG. 6, it will be seen that the parallelepipedal chamber 137 comprises an opening 143 on one narrow face 140. The opening 143 reveals the graduation of the tube 128, marking the position of the piston 141 and making it possible to determine the pressure in the interior of the container.

The section of the cam 112 is of course determined, like that of the cam 12, so as to ensure substantially isothermal compression of the gas at constant power.

We claim:

1. Device for the compression of a fluid, particularly for the pressure filling of a container, comprising a motor, a pump body, a piston adapted to be displaced linearly in said pump body, transmission means between the motor and said piston adapted to convert the rotary motion generated by the motor into a reciprocating, translatory motion by the piston, speed varying means adapted to impart a different speed to said piston according to the resistance opposing the motor during one complete admission and compression cycle, so that the resisting torque is substantially constant, wherein:

the compression fluid is a gas;

the speed varying means includes a cam for controlling displacement of piston to satisfy the relation PV=constant, for an isothermal compression of a perfect gas, where P is the pressure of the compressed fluid and V is the volume of the compressed fluid, and the cam allows for compression of the compressed fluid at constant power; and the speed varying means limiting heating of the compressed fluid which results from a difference between theoretical properties of a perfect fluid and actual properties of the compressed fluid as well as friction by controlling piston speed thus ensuring substantial isothermal compression; and wherein:

the pump body is a syringe body having a cylindrical wall connected by a truncated wall to a nose;

a casing is included having an end fitting at a closed end containing the syringe body, the end fitting being located at the nose and connected by a pipe to the container.

2. Device according to claim 1, characterised in that the syringe body (3, 103) comprises an outlet valve (18, 118), the said outlet valve (18, 118) consisting of a flexible sleeve (19, 119) arranged around the nose (6, 106) of the syringe (3, 103), the nose (6, 106) of the syringe comprising at least one opening (20, 120) covered by this sleeve (19, 119), so that the opening is open during the compression phase and closed during the admission phase.

3. Device according to claim 2, characterised in that the longitudinal axis of the spring of the adjusting means extends substantially parallel to the axis of the syringe body (3, 103), the different elements being supported by a frame (36, 136), the motor (1, 101) being disposed between the longitudinal axis of the spring of the adjusting means and the syringe body (3, 103), with its axis substantially orthogonal to the plane of the longitudinal axis of the spring of the adjusting means and the axis of the syringe body (3, 103).

4. Device according to claim 1, characterised in that the end fitting (8) is movable and slidably mounted in an end bore of the casing (7).

5. Device according to claim 4, characterised in that it comprises a pressure switch consisting of a miniature switch (25) and means (26) for adjusting the cut-off pressure controlled by a lever (27), the said adjusting means (26) comprising an adjusting rod (33) between the miniature switch (25) and the lever (27), the lever (27) being connected at one of its ends to the end fitting and at its other end to the adjusting means (26), and being mounted to pivot about an intermediate axis (D), so that when the pressure in the container (9*a*) exceeds the calibration pressure, the end fitting (8) is displaced, resulting in rotation of the lever (27), displacement of the adjusting rod (33) and cut-off of the motor (1) by the miniature switch (25).

6. Device according to claim 1, characterised in that it comprises a pressure switch consisting of a miniature switch (125) and means (126) for adjusting the cut-off pressure, the said adjusting means (126) comprising a tube (128), particularly a transparent, graduated tube, connected to the pipe (109) running from the end fitting (108) to the container and in which a piston (141) held back by a draw spring (130) is displaced under the influence of the pressure of the fluid, so that when the pressure in the container exceeds a predetermined maximum admissible pressure, the piston (141) cuts off the motor (101) via the miniature switch (125).

7. Device according to claim 6, characterised in that the tube (128) comprises an orifice (142) situated towards the end of the tube at which the piston (141) is located at the end of its stroke, the whole assembly being such that the piston uncovers this orifice, thereby establishing leakage to the atmosphere when the predetermined maximum admissible pressure is reached in the container.

8. Device according to claim 6, characterised in that the tube (128) is open at its end close to the miniature switch (125) so that the piston (141) emerges from the tube (128) when the predetermined maximum admissible pressure is exceeded in the container.

9. Device for the compression of a fluid, particularly for the pressure filling of a container, comprising a motor, a pump body, a piston adapted to be displaced linearly in said pump body, transmission means between the motor and said piston adapted to convert the rotary motion generated by the motor into a reciprocating, translatory motion by the piston, speed varying means adapted to impart a different speed to said piston according to the resistance opposing the motor during one complete admission an compression cycle, so that the resisting torque is substantially constant, wherein:

the compression fluid is a gas;

the speed varying means includes a cam for controlling displacement of piston to satisfy the relation PV=constant, for an isothermal compression of a perfect gas, where P is the pressure of the compressed fluid and V is the volume of the compressed fluid, and the cam allows for compression of the compressed fluid at constant power; and the speed varying means limiting heating of the compressed fluid which results from a difference between theoretical properties of a perfect compressed fluid and actual properties of the compressed fluid as well as friction by controlling piston speed thus ensuring substantial isothermal compression so that the piston speed is less than 10 Hz; and the cam has a contour and operates at a constant rotational speed, the contour is included between 2 limit curves having polar radii for an angle Θ of 0.9 R and 1.1 R respectively, R is determined by the following equation:

$$R = R_o + (R_m - R_o)\frac{P_m}{P_m - P_o}\left[1 - \left(\frac{P_o}{P_m}\right)^{\theta/\theta_m}\right]$$

where $R_o$ and $R_m$ are minimum and maximum polar radii, $\Theta_m$ is a polar angle corresponding to maximum polar radii $R_m$, and $P_o$ and $P_m$ are minimum and maximum pressures of a compressed fluid.

10. Device according to claim 9, characterised in that the speed of the piston (2, 102) is less than 3 Hz.

11. Device as claimed in claim 9 wherein the transmission means includes a toothed wheel, and a toothed pinion fixed to a shaft of the motor and meshes with the toothed wheel to form a reducer;

a first axis is operationally connected to the cam and the center of the toothed wheel;

the speed varying means further includes a roller in contact with a periphery of the cam;

a balancer having a first and second end, the first end being fixed to the roller;

a rod having a first end connected to the piston and a second end connected to the second end of the balancer.

12. Device according to claim 9, further comprising:

a frame;

an elastic means having first and second ends, the first end connected to the frame and second end connected to the balancer the first and second ends connected such that an increase in force of the elastic means when the roller moves away from a centre of the cam is substantially compensated.

13. Device for the compression of a fluid, particularly for the pressure filling of a container, comprising a motor, a pump body, a piston adapted to be displaced linearly in said pump body, transmission means between the motor and said piston adapted to convert the rotary motion generated by the motor into a reciprocating, translatory motion by the piston, speed varying means adapted to impart a different speed to said piston according to the resistance opposing the motor during one complete admission and compression cycle, so that the resisting torque is substantially constant, wherein:

the compression fluid is a gas;

the speed varying means includes a cam for controlling displacement of piston to satisfy the relation PV=constant, for an isothermal compression of a perfect gas, where P is the pressure of the compressed fluid and V is the volume of the compressed fluid, and the cam allows for compression of the compressed fluid at constant power; and the speed varying means limiting heating of the compressed fluid which results from a difference between theoretical properties of a perfect compressed fluid and actual properties of the compressed fluid as well as friction by controlling piston speed thus ensuring substantial isothermal compression; and wherein the device includes a rod having orifice;

a loss of motion device for operationally connecting the rod to the piston so that in a drive phase of the piston the orifice is opened, allowing for aspiration, while in a thrust phase the orifice is closed, allowing for compression.

14. Device according to claim 13, wherein;

the orifice of the piston is coaxial with the piston;

the loss of motion device comprises a unit, connected to the piston, in which there is provided an axial housing having a larger diameter over its length, and the rod comprises a larger diameter over a part of its length, in the axial housing, the part (15*a*) of the rod (15) having the larger diameter being less than the axial housings length.

15. Device according to claim 14 wherein the loss of motion device comprises:

a ball fixed to an end of the rod connected to the piston; a housing having a volume greater than the ball, the ball being situated in the housing; and an annular lip surrounding the orifice in the interior of the housing.

16. A compression assembly comprising:

a plurality of compression devices disposed in parallelepipedal chambers having two large faces and two narrow faces, the chambers being arranged in parallel large face against; and an outlet end fitting a lever and end of an adjusting screw projecting out from one of the two narrow faces; wherein each device for the compression of a fluid, particularly for the pressure filling of a container, comprising a motor, a pump body, a piston adapted to be displaced linearly in said pump body, transmission means between the motor and said piston adapted to convert the rotary motion generated by the motor into a reciprocating, translatory motion by the piston, speed varying means adapted to impart a different speed to said piston according to the resistance opposing the motor during one complete admission and compression cycle, so that the resisting torque is substantially constant, wherein:

the compression fluid is a gas;

the speed varying means includes a cam for controlling displacement of piston to satisfy the relation PV=constant, for an isothermal compression of a perfect gas, where P is the pressure of the compressed fluid and V is the volume of the compressed fluid, and the cam allows for compression of the compressed fluid at constant power; and the speed varying means limiting heating of the compressed fluid which results from a difference between theoretical properties of a perfect compressed fluid and actual properties of the compressed fluid as well as friction by controlling piston speed thus ensuring substantial isothermal compression.

17. A compression assembly comprising:

a plurality of devices for the compression of a fluid disposed in parallelepipedal chambers having two large faces and two narrow faces, the chambers arranged parallel to one another with large face against large face of each adjacent device; and a graduation tube being visible on one of the two narrow faces; wherein each device for the compression of a fluid, particularly for the pressure filling of a container, comprising a motor, a pump body, a piston adapted to be displaced linearly in said pump body, transmission means between the motor and said piston adapted to convert the rotary motion generated by the motor into a reciprocating, translatory motion by the piston, speed varying means adapted to impart a different speed to said piston according to the resistance opposing the motor during one complete admission and compression cycle, so that the resisting torque is substantially constant, wherein:

the compression fluid is a gas;

the speed varying means includes a cam for controlling displacement of piston to satisfy the relation PV=constant, for an isothermal compression of a perfect gas, where P is the pressure of the compressed fluid and V is the volume of the compressed fluid, and the cam allows for compression of the compressed fluid at constant power; and the speed varying means limiting heating of the compressed fluid which results from a difference between theoretical properties of a perfect compressed fluid and actual properties of the compressed fluid as well as friction by controlling piston speed thus ensuring substantial isothermal compression.

* * * * *